US006113366A

United States Patent [19]

Hobson

[11] Patent Number: 6,113,366

[45] Date of Patent: Sep. 5, 2000

[54] BLOW-MOLDED, ONE PIECE, TWO PLASTIC APPARATUS FOR PRESSURIZING A VESSEL

[76] Inventor: Gerald R. Hobson, 21721 Wildwood Pl., Shell Rock, Iowa 50670

[21] Appl. No.: 09/197,762

[22] Filed: Nov. 23, 1998

[51] Int. Cl.[7] ..... F04B 43/08

[52] U.S. Cl. ..... 417/472

[58] Field of Search ..... 417/472; 222/207, 222/209

[56] References Cited

U.S. PATENT DOCUMENTS

| | | | |
|---|---|---|---|
| 2,680,477 | 6/1954 | Schira, Jr. | 417/472 |
| 3,215,084 | 11/1965 | Cline | 417/472 |
| 3,409,184 | 11/1968 | Stengle | 222/207 |
| 4,552,515 | 11/1985 | Endo | 417/472 |
| 4,738,612 | 4/1988 | Kikuchi | 425/532 |
| 4,767,303 | 8/1988 | Sakakura | 425/203 |
| 4,858,478 | 8/1989 | Kush et al. | 417/472 |
| 4,863,070 | 9/1989 | Andris | 222/207 |
| 4,915,601 | 4/1990 | von Schuckmann | 417/472 |
| 4,947,491 | 8/1990 | Parkinson | 4/321 |
| 5,197,866 | 3/1993 | Kim | 417/472 |
| 5,749,850 | 5/1998 | Williams | 604/74 |
| 5,827,052 | 10/1998 | Wang | 417/472 |

FOREIGN PATENT DOCUMENTS

| | | | |
|---|---|---|---|
| 203885 | 12/1982 | Japan | 417/472 |

OTHER PUBLICATIONS

Copy—4 pages—Brochure entitled World First 3–D Blow Molding Machine New 2XY–5.5/9—Compact Design by Placo Co., Ltd, no date.

*Primary Examiner*—Willis R. Wolfe
*Attorney, Agent, or Firm*—Henderson & Sturm LLP

[57] ABSTRACT

An apparatus for pressurizing a vessel of a type including a one piece blow molded hollow member, a first end and a second end of the member being constructed of a first plastic material, the one end being adapted to be attached to and in fluid communication with a pressure vessel. An intermediate bellows portion of the member is constructed of a plastic, such as a thermoplastic elastomer, that is more flexible and less rigid than the first plastic material, such as polypropylene, whereby the intermediate bellows portions can flex to change in size to vary the volume of fluid therein. A first one-way valve is operatively disposed in the first end of the molded hollow member for permitting flow from the interior of the intermediate bellows portion to the pressure vessel when the intermediate bellows portion is reduced in volume, but not allowing flow from the pressure vessel to the intermediate bellows portion as the intermediate bellows portion of returns to a larger volume. A second one-way valve is operatively disposed in a second end of the molded hollow member for permitting flow of fluid from outside of the hollow member to the interior of the intermediate bellows portion as the intermediate bellows portion moves from a reduced volume to a larger volume and prevents the flow of fluid therethrough as the intermediate bellows portion moves from a larger volume to a reduced volume.

7 Claims, 2 Drawing Sheets

BLOW-MOLDED, ONE PIECE, TWO PLASTIC APPARATUS FOR PRESSURIZING A VESSEL

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to an apparatus for pressurizing a vessel, and more particularly to a blow-molded, one piece, two plastic device for pressurizing a vessel.

2. Description of the Related Art

The prior art devices which are used to pump fluids or pressurize a vessel are typically composed of many parts. This creates problems from the standpoint of the cost of manufacture and also for dependability. Consequently, there is a need for a cheaper and more dependable pump for a pressurizing device.

BRIEF SUMMARY OF THE INVENTION

The present invention relates to an apparatus for pressurizing a vessel including a one piece, blow-molded member having a first end constructed of a first plastic material, said first end being adapted to be attached to and in fluid communication with the pressure vessel. A blow-molded hollow member has a second end which in a preferred embodiment is constructed of the same plastic material as the first end. An intermediate bellows portion of the blow-molded member is integrally formed in one piece with the first and second end of the hollow member and is constructed of a plastic that is more flexible and less rigid than the end portions of the blow-molded hollow member whereby the intermediate bellows can flex to change in size to vary the volume of fluid therein. A first one-way valve is operably disposed in one end of the blow-molded hollow member for permitting flow from the interior of the intermediate bellows portion to the pressure vessel when the intermediate bellows portion is reduced in volume but not allowing flow from the pressure vessel to the intermediate bellows portion as the intermediate bellows portion returns to a larger volume. A second one-way valve is operably disposed in the other end thereof for permitting flow of fluid from outside of the hollow member to the interior of the intermediate bellows portion as the intermediate bellows portion moves from a reduced volume to a larger volume and prevents the flow of fluid therethrough as the intermediate bellows portion moves from a larger volume to a reduced volume.

The blow-molded hollow member is formed in a 3-D blow-molding chain such as the model 2XY-5.5/9 from Placo Machinery Inc. of Torrence, Calif., a 4-page color brochure thereof being cited herein and being incorporated herein by reference. This type of blow-molding machine allows two different materials to be used to blow mold a one-piece member and the one-piece member in this case is a bellows portion formed of a thermoplastic elastomer material with the ends being a more rigid plastic material such as polypropylene.

An object of the present invention is to provide an improved apparatus for pressurizing a vessel or alternatively for providing a one-piece pump.

Another object of the invention is to provide an apparatus for pressurizing a vessel which is cheaper to make than those with more complex parts and furthermore being more dependable than those with many parts because there are no seams and connection points that require sealing to avoid leaks.

Other objects, advantages, and novel features of the present invention will become apparent from the following detailed description of the invention when considered in conjunction with the accompanying drawings.

DETAILED DESCRIPTION OF THE INVENTION

Figure 1:
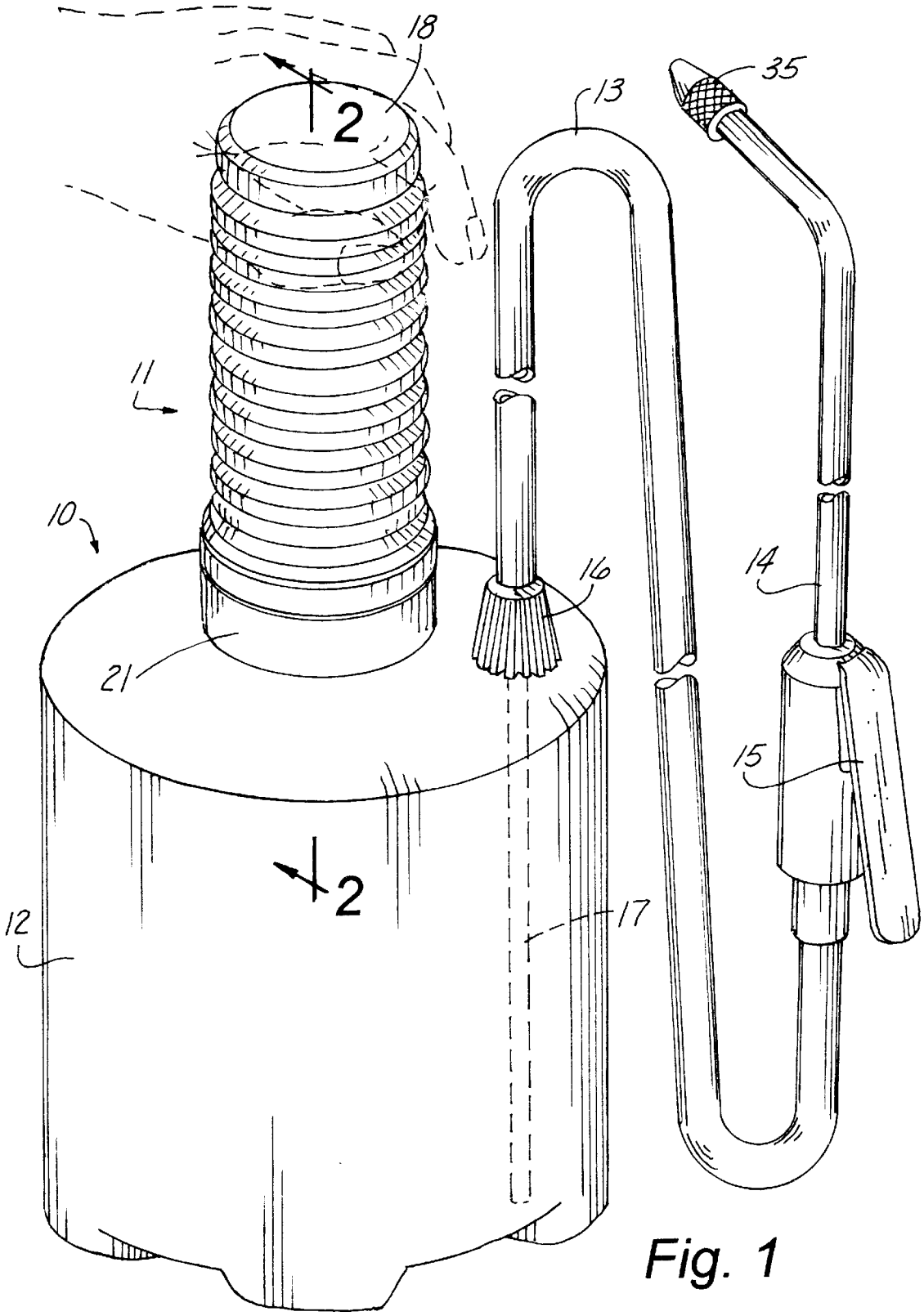
FIG. 1 is a perspective view of a handheld sprayer having the present invention threadably attached to the top thereof and having a hose and wand attached to the pressure vessel for spraying a fluid from the pressure vessel once it has been pressurized by the pump of the present invention.

Referring now to the drawings, wherein like reference numerals designate identical or corresponding parts throughout the several views, FIG. 1 shows the present invention depicted generally at (10) and including an apparatus (11) attached to a pressure vessel (12) which has a hose (13), wand (14), nozzle (35) and a trigger-type valve (15) attached between the wand (14) and the hose (15). A connector (16) attaches to the pressure vessel (12) and has a conduit (17), shown in dashed lines, which goes to the bottom of the pressure vessel (12).

Figure 2:
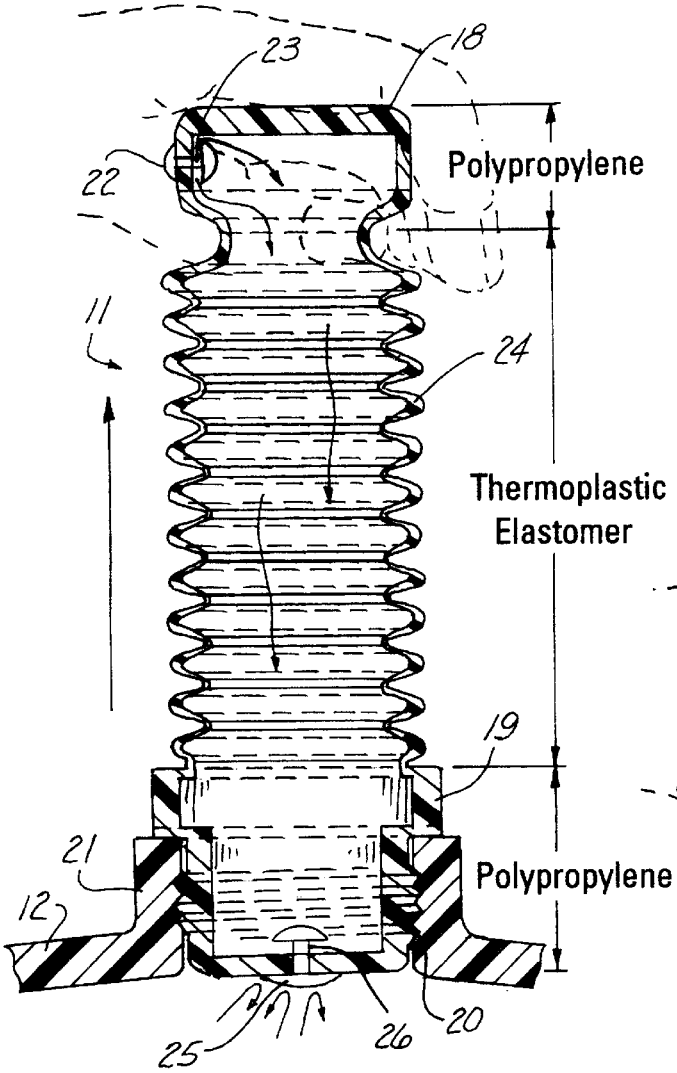
FIG. 2 is a cross sectional view of the present invention in an expanded form showing the pressure vessel partially pressurized.

Referring now to FIG. 2, the pressurizing apparatus (11) has a first portion (18) which is made of a somewhat rigid material such as polypropylene and a second end (19) which is also preferably made of the same polypropylene material. The second end (19) has threads (20) thereon which meet with threads inside the neck (21) of the pressure vessel (12). The portion (18) of the pressurizing device (11) constitutes a handle which can be grasped by the hand shown in dashed lines in FIGS. 1, 2, and 3. A first one-way valve (22) extends through an opening (23) in the handle (18) and this valve (22) has an enlarged head on each end thereof and a stem which extends therethrough. This valve (22) is placed in the pressurizing apparatus (10) after the one-piece portion (18), (19) and intermediate bellows portion (24) are formed by merely pushing the inside head of the valve member (22) and forcing it through the opening (23) in the handle (18).

The intermediate bellows portion (24) is constructed of a thermoplastic elastomer such as a SANTOPRENE® thermoplastic elastomer. Because the polypropylene material of handle (18) and threaded end (10) are of a more rigid material, they will work better with the threads (20) and handle (18) than if the entire device was made of a thermoplastic elastomer. Furthermore, polypropylene will not work properly, at least in its normal form, as a bellows for the intermediate portion (24) like the thermoplastic elastomer does because of the flexibleness of thermoplastic elastomer material. A valve (25) also extends through an opening (26)

in the end (19) of the pressurizing device (11) and the enlarged heads on each end of the valve (25) operate just like the valve (22). In fact valve (25) can be identical to the valve (22) if desired. Of course, these valves (22), (25) can also be of different types since there are many types of one-way valves which will work in practically any pump or pressurizing device. This is no exception. The enlarged head on the inside of the valve (25) would be pushed through the opening (26) to the position shown in FIG. 2.

In operation, once the apparatus (10) is assembled as shown in FIG. 1, the valve (15) will be biased to a closed position as is common in this type of hand held pressurized sprayer. The vessel (12) would be filled, but not completely, with a liquid to be sprayed. After the pressurizing device (11) is screwed into the top and mates with the threads on neck (21) of the pressurized vessel (12), the pressurizing process can begin.

Figure 3:
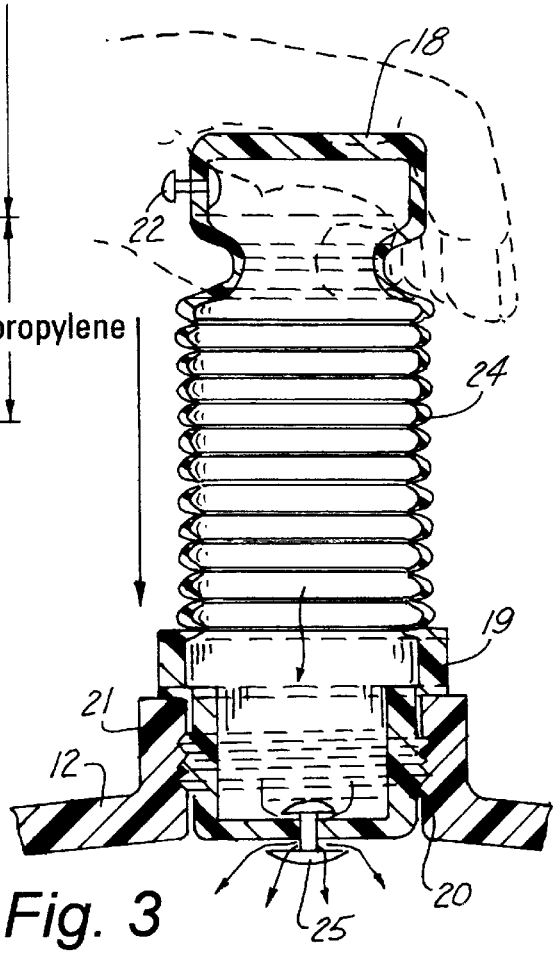
FIG. 3 is a cross sectional view of the pressurizing apparatus of the present invention shown in its most compact position whereby air has been pushed out of the interior thereof and into the pressure vessel.

The process of pressurizing the vessel (12) is as simple as pushing on the top of the handle (18) from the position shown in FIG. 2 to the position shown in FIG. 3 wherein the valve (22) will prevent air from exiting through the handle portion (18) and will force air past the bottom valve (25) as shown in FIG. 3. When the operator removes his/her hand from the top of the handle (18), the bellows portion (21) will move back to the position shown in FIG. 2 because of its natural tendency to assume this original position, much like a spring will return to its original position after having been moved to the different position.

When the bellows or intermediate portion (24) moves from the position shown in FIG. 3 to the position shown in FIG. 1, the valve (25) prevents flow from the pressurizing vessel (12) into the bellows portion (24) but while the bellows portion (24) is moving from the position shown in FIG. 3 to the position shown in FIG. 2, air will enter through the handle (18) past the valve (22) into the bellows portion (24) because the pressure inside of the bellows portion (24) will be below atmospheric pressure after all of the air has been pushed out, as shown in FIG. 3. This process is then merely repeated over and over until such time that it is difficult to push down on the bellows (24) between the FIG. 2 and FIG. 3 position, which will mean to the operator that the pressure vessel (12) is pressurized sufficiently for spraying. Then the sprayer can be used in its normal fashion by merely pointing the nozzle (35) of the wand (14) and toward whatever is to be sprayed and squeezing the handle (15) to release the pressurized liquid in the pressure vessel (12) through the conduit (17), hose (13), valve (15), wand (14) and nozzle (35). Then, of course, once there is insufficient pressure in the vessel (12) to do the spraying desired, the pressurizing process referred to above is repeated until there is sufficient pressure in the vessel (12).

Accordingly, it will be appreciated that the present invention does indeed accomplished the aforementioned objects. Obviously many modifications and variations of the present invention are possible in light of the above teachings. It is therefore to be understood that, within the scope of the appended claims, the invention may be practiced otherwise than as specifically described.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An apparatus for pressurizing a vessel comprising:

a one piece blow-molded hollow member;

a first end of the member being constructed of a first plastic material, said first end being adapted to be attached to and in fluid communication with a pressure vessel;

a second end of the member;

an intermediate bellows portion of said member being sealingly attached at one end to said first end and sealingly attached at the other end thereof to said second end, said first, second and intermediate bellows portions being integrally made in one piece, said intermediate bellows portion being constructed of a plastic that is more flexible and less rigid than said first plastic material whereby said intermediate bellows portion can flex to change in size to vary the volume of fluid therein;

a first one-way valve operatively disposed in said first end thereof for permitting flow from the interior of the intermediate bellows portion to said pressure vessel when the intermediate bellows portion is reduced in volume, but not allowing flow from the pressure vessel to said intermediate bellows portion as the intermediate bellows portion returns to a larger volume; and a second one-way valve operatively disposed in said second end thereof for permitting flow of fluid from outside of the hollow member to the interior of the intermediate bellows portion as the intermediate bellows portion moves from a reduced volume to a larger volume and prevents the flow of fluid therethrough as the intermediate bellows portion moves from a larger volume to a reduced volume.

2. The apparatus of claim 1 wherein said second end of the member is made of said first plastic material.

3. The apparatus of claim 1 wherein said first material is polypropylene.

4. The apparatus of claim 1 wherein said intermediate bellows portion is constructed of a thermoplastic elastomer material.

5. The apparatus of claim 1 wherein said first material is polypropylene and the intermediate bellows portion of the hollow member is made of thermoplastic elastomer material.

6. The apparatus of claim 1 wherein said second end is a handle for manually engaging in order to move the intermediate bellows portion from a larger volume to a reduced volume condition.

7. The apparatus of claim 1 wherein the first end of the molded hollow member has threads thereon adapted to sealingly mate with threads on the pressure vessel.

* * * * *